US006673159B1

(12) United States Patent
Jones et al.

(10) Patent No.: US 6,673,159 B1
(45) Date of Patent: Jan. 6, 2004

(54) CLEANING BRUSH AND METHOD FOR REMOVING CONTAMINATES FROM A PHOTOCONDUCTOR FILM

(75) Inventors: Kurt E. Jones, Webster, NY (US); Douglas D. Fisher, Marion, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 60 days.

(21) Appl. No.: 09/669,710

(22) Filed: Sep. 26, 2000

(51) Int. Cl.[7] ..... B08B 7/00

(52) U.S. Cl. ..... 134/6; 134/9; 134/21; 15/300.1; 15/363; 15/77; 15/102

(58) Field of Search ..... 134/6, 9, 21; 15/179, 15/97.1, 100, 102, 77, 88.4, 256.51, 256.52, DIG. 5, DIG. 6, 300.1, 363

(56) References Cited

U.S. PATENT DOCUMENTS 5,436,714 A * 7/1995 Suzuki ..... 15/179

FOREIGN PATENT DOCUMENTS

| | | | | |
|---|---|---|---|---|
| EP | 0 089 432 A1 | | 3/1982 | ..... G03G/21/00 |
| EP | 0 620 508 A1 | | 4/1994 | ..... G03G/21/00 |
| EP | 0 668 549 A3 | | 2/1995 | ..... G03G/15/20 |
| JP | 05053486 A | * | 3/1993 | ..... G03G/21/00 |
| JP | 05-053486 | | 3/1999 | ..... G03G/21/00 |
| JP | 11305621 | | 11/1999 | ..... G03G/21/10 |

* cited by examiner

*Primary Examiner*—Alexander Markoff

(57) ABSTRACT

A method and a cleaning brush for removing contaminants from and extending the life of a photoconductor film wherein the cleaning brush has end sections having a reduced coefficient of friction with the end sections of the photoconductor film which are less frequently used.

16 Claims, 3 Drawing Sheets

CLEANING BRUSH AND METHOD FOR REMOVING CONTAMINATES FROM A PHOTOCONDUCTOR FILM

FIELD OF THE INVENTION

This invention relates to an improved cleaning brush for removing contaminates from a photoconductor film used in electrophotographic processes.

BACKGROUND OF THE INVENTION

In the production of copies by electrophotographic processes a continuous loop of photoconductor film is commonly used. This photoconductor film is charged initially, thereafter passed through an imaging section, a developing section and an image transfer section where the image on the photoconductor film is transferred to a paper to produce a copy of the image on the paper. The paper is subsequently passed through a fuser section where a toner image on the paper is fixed to the paper by elevated temperature and pressure in the fuser section. The photoconductor film then passes through a neutralization section and thereafter past a brush cleaner which removes contaminates from the film prior to passing the photoconductor film back through the primary charging section. Typically contaminates removed from the photoconductor film by the cleaning brush are recovered from the brush by the use of a vacuum suction device. This device may comprise a wide mouth vacuum fixture which is in engagement with the brush or it may comprise a housing around the brush which is adapted to draw a gaseous flow through the housing.

In such processes the central 11 inch portion of the photoconductor film is the most commonly used area of the film. In other words most copies produced are 11 inches in length and this length, referred to herein as width, is positioned perpendicular to the length of the film and this portion of the film is repeatedly used to produce copies 11 inches in width. As a result this central section of the photoconductor film is exposed to paper and to toner and other materials which may come in contact with the photoconductor film during the copying process. The brush is used to clean such materials from the entire width of the photoconductor film prior to re-charging the film in the primary charging section. It has been observed that the photoconductor film in the areas outside the central section becomes worn more rapidly by the cleaning brush than does the more actively used central portion of the photoconductive film. Further it has been observed that contaminants (scum) tend to accumulate on the photoconductive film outside the central portion to a greater extent than in the central portion of the film. This accumulation can result in a defect referred to frequently as charger rust defect. In other words as the photoconductor film passes through the successive charging, discharging and other steps the accumulated contaminates on the portions of the photoconductor film outside the central portion of the film result in poor image quality.

Accordingly a continuing effort has been directed to methods for developing an improved cleaning brush to minimize the accelerated wear on the end portions of the photoconductor film, reduce the scum and the incidence of charger rust defect and extend the life of the photoconductor film.

SUMMARY OF THE INVENTION

According to the present invention it has been found that an improved result is achieved by the use of a rotary cleaning brush for removing contaminates from a photoconductor film used in an electrophotographic process. The brush comprises a brush surface comprising brush fibers around a brush core, the brush surface having brush surface ends, a central portion of the brush surface having outer ends and end portions of the brush surface positioned between the brush surface ends and the outer ends, the end portions of the brush surface having a lower coefficient of friction with the film than the central portion of the brush surface.

In a further embodiment, the brush comprises a brush surface comprising brush fibers around a brush core, the brush surface having brush surface ends, a central portion of the brush surface having outer ends and a central portion outer diameter; and, end portions of the brush surface positioned between the brush surface ends and the outer ends and having an end portion outer diameter less than the central portion outer diameter.

The invention further comprises a method for extending the life of a photoconductor film in an electrophotographic process wherein the film is cleaned by a rotary brush, the method comprising: cleaning a middle portion of the film by contact with the brush at a first coefficient of friction; and, cleaning end portions of the film by contact with the brush at a second coefficient of friction, the second coefficient of friction being less than the first coefficient of friction.

It has also been found that improved results are achieved by a method for removing contaminates from a photoconductor film in an electrophotographic process, the method comprising: forming a rotary cleaning brush to have a central portion and end portions with the central portion having an outer diameter from about 0.01 to about 0.05 inches greater than the outer diameter of the end portions; supporting the rotary cleaning brush to engage the photoconductor film in its central portion at an engagement of from about 0.02 to about 0.07 inches; and passing the photoconductor film past and in engagement with the rotary cleaning brush to remove contaminants from the photoconductor film.

It has also been discovered that an improvement is achieved in a method for removing contaminants from a photoconductor film used in an electrophotographic process by passing the photoconductor film past and in engagement with a rotary cleaning brush with contaminants being at least partially removed from the cleaning brush, the improvement comprising forming the rotary cleaning brush to have a central portion which engages a central portion of the photoconductor film and end portions which engage end portions of the photoconductor film with an outer diameter of the central portion of the cleaner brush being from about 0.01 to about 0.05 inches greater than an outer diameter of the end portions of the cleaning brush.

It has further been discovered that an improvement is achieved in a method for removing contaminants from a photoconductor film used in an electrophotographic process by passing the film past and in engagement with a rotary cleaning brush with contaminants being at least partially removed from the cleaning brush, the improvement comprising: forming the rotary cleaning brush to have a central portion which engages a central portion of the photoconductor film and end portions which engage end portions of the photoconductor film and reducing the coefficient of friction between the end portions of the film and the end portions of the brush.

DESCRIPTION OF THE PREFERRED EMBODIMENTS

In the discussion of the Figures, the same numbers will be used throughout to refer to the same or similar features.

Figure 1:
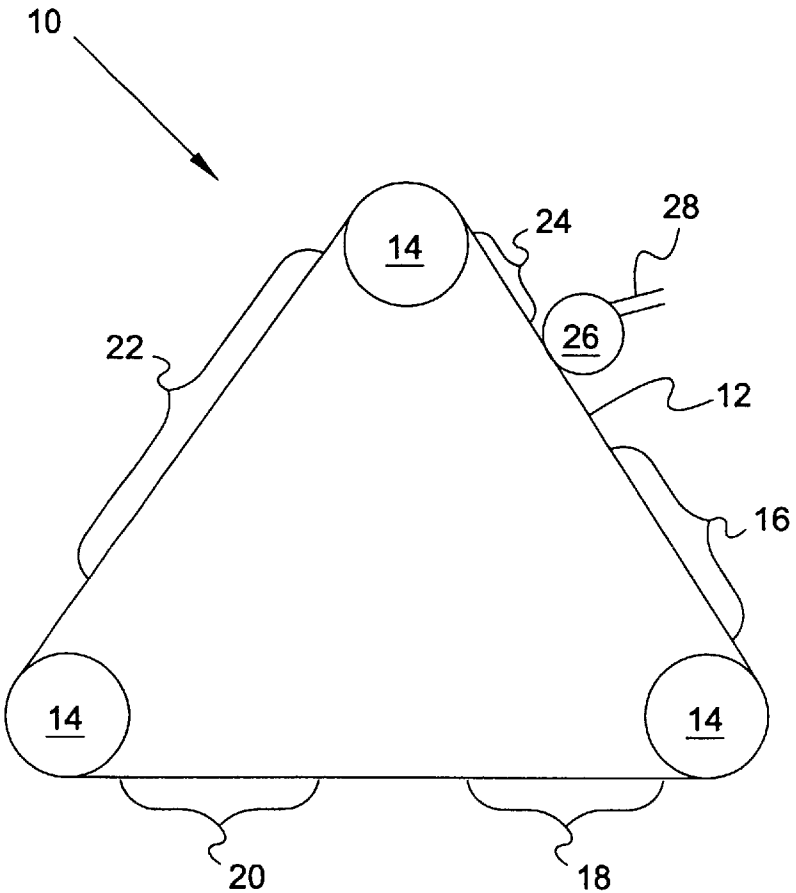
FIG. 1 (PRIOR ART)
FIG. 1 is a schematic diagram of a representative prior art electrophotographic process utilizing a photoconductor film in a continuous loop.

In FIG. 1 a schematic diagram 10 of the flow path of a photoconductor film in an electrophotographic process is shown. A photoconductor film 12 is shown schematically supported by three rollers 14. The photoconductor film is typically charged in a primary charging section 16 by a corona discharge system(not shown) or the like. The charged film then passes to an imaging section 18 where an image is transmitted electrophotographically, digitally or the like as known to those skilled in the art to the film. The film then passes through a developing section 20 where a toner which comprises a polymer which is adapted to become fixed to paper to produce a copy is positioned on the desired image. The image may be either a positive or a negative image as desired. The film is then passed to an image transfer section 22 where the toner forming the image is transferred to a paper which is typically charged to receive the toner from the photoconductor film. The paper is subsequently passed through a fuser section (not shown) where the toner is caused to become fixed to the paper by heat and pressure to produce the finished copy. The photoconductor film is then passed to a neutralization section 24 where it is neutralized by any suitable system such as a corona discharge system (not shown). The photoconductor film is then contacted by a brush cleaner 26 which typically rotates in a direction such that the brush surface contacts the film in a direction opposite the flow of the film past the brush. Contaminants removed by the brush are removed at least partially from the brush by any suitable means such as by a vacuum suction system shown schematically at 28. The photoconductor film then passes back to the primary charging section and the process is repeated. Such processes are well known to those skilled in the art and while they involve considerably more complexity than detailed above it is considered that such processes are well known and need not be discussed further.

In such processes the photoconductor film comes into contact with toner in developing section 20. During the transfer of the image to the paper small quantities of toner are frequently left on the photoconductor film as well as paper dust and possibly other contaminates resulting from the process. These materials are typically left most frequently in an 11 inch wide central portion of the photoconductor film which may be from about fifteen (15) to about nineteen (19) inches in total width. The total width is necessary to produce copies which may be greater than 11 inches in width. While such copies can be produced in the copying machine, copies of this width are relatively infrequently produced. As a result the areas of the photoconductor film outside the central portion of the photoconductor do not encounter toner in most instances and do not encounter paper directly in most instances. Since the paper can remove paper dust and various other contaminants from the film when contacted with the film, the center portion of the film has reduced quantities of paper dust which become residual on the film. Further the middle portion of photoconductor film contains residual quantities of toner which function as a lubricant during the contact of the film with a brush cleaner. For these and a variety of other reasons it has been found that when a brush cleaner is used to clean the photoconductor film, the end portions of the photoconductor film become worn more quickly than the more frequently used central portion of the photoconductor film. The material which is worn from the film is collected on the brush. As the brush rotates against the film it may deposit a portion of the worn material back onto the film. The end portions of the film form sites for scum and charger rest defect. The image quality deterioration is seen when long copies are produced periodically.

Figure 2:
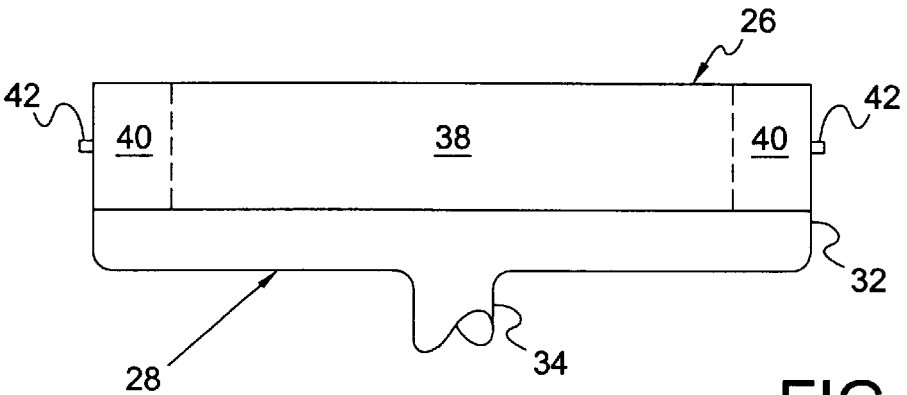
FIG. 2 (PRIOR ART)
FIG. 2 is a schematic diagram of a prior art brush cleaner.

In FIG. 2 a prior art brush 26 having a central section 38 is shown. Central portion 38 is typically eleven inches in width and corresponds to the most frequently used portion of the film. End portions 40 of cleaning brush 26 are also shown. Brush 26 has a substantially constant diameter and substantially uniform consistency along its length and of course contacts the photoconductor film uniformly along its length. This uniform contact C5, Am results in uneven wear of the photoconductor film in the end sections 40 of the photoconductor film as discussed above. Cleaning brush 26 as shown includes supports 42 which are positioned on a brush core (not shown) for rotatively supporting cleaning brush 26 in the desired engagement with the film. A brush cleaner 28 is shown. Brush cleaner 28 comprises a vacuum head 32 and a vacuum line 34 so that the entire length of brush 28 is subjected to a vacuum suction to remove contaminates from brush 26 as it rotatively contacts the photoconductor film. Processes such as discussed in connection with FIG. 1 and the use of brushes as shown in FIG. 2 are considered to be well known to those skilled in the art.

Figure 3:
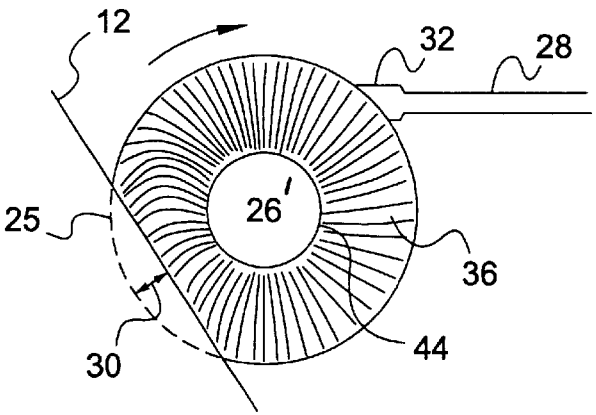
FIG. 3 is a schematic diagram of an embodiment of a brush cleaner in engagement with a photoconductor film.

In FIG. 3 a representative engagement of brush 26' is shown. Brush 26' is shown in contact with film 12 to an engagement depth 30 which is desirably from about 0.02 to about 0.07 inches. The unengaged profile of brush 26' is shown by dotted line 25.

Figure 4:
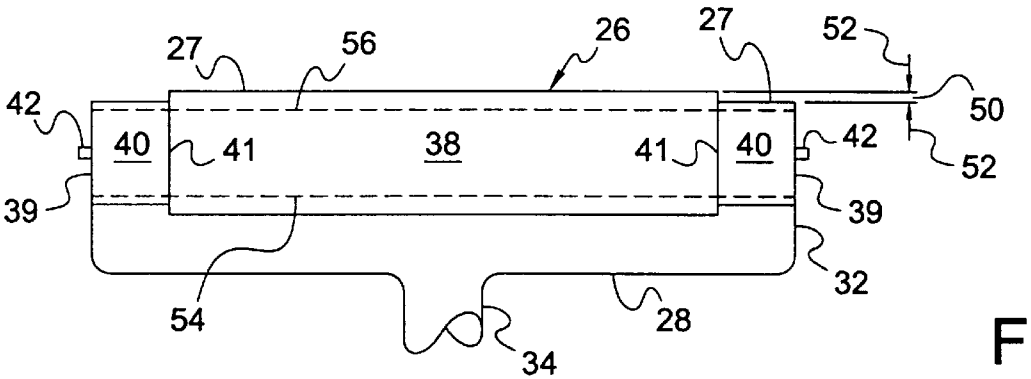
FIG. 4 is a schematic diagram of a brush cleaner according to the present invention.
Figure 5:
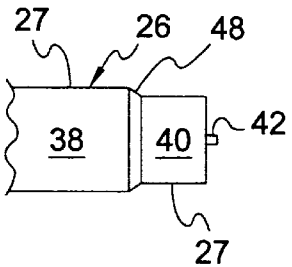
FIG. 5 is a schematic diagram of an end portion of a brush cleaner according to the present invention; and, FIG. 6 is a schematic diagram of a further embodiment of a brush cleaner according to the present invention.

In FIG. 4 an embodiment of the present invention is shown. In FIG. 4, brush 26', as shown, includes reduced diameter end portions 40. The brush surface 27 comprises brush fibers as known to those skilled in the art such as Acrylic fibers which are well known to be resistant to oil, grease, ozone, oxidation and the like. Desirably the Acrylic fibers have an oil finish. These fibers are of a size and length known to those skilled in the art for use for cleaning photoconductor films. Some suitable fibers are available under the trade mark ACRYLON from Borden Chemical Company, Columbus, Ohio. These fibers are supported on a core (not shown) as well known to those skilled in the art to form brush 26'. The construction of brush 26', as shown in FIG. 2, is considered to be well known to those skilled in the art and will not be discussed further. The improvement of the present invention comprises a reduction in the diameter of the cleaning surface of brush 26' in the end portions 40 as shown at 50 by arrows 52. The reduction in diameter is typically from about 0.02 to about 0.07 inches. This reduction in diameter enables the engagement of the film to a lesser extent by the end portions of the film. As shown by dotted line 56 the film is engaged to a lesser extent by end portions 40 of brush 26' when the end portions have a reduced diameter as discussed above. The reduced diameter may represent a sudden transition in diameter or it may be tapered at a taper 48 or other configuration as shown in FIG. 5. It is desirable that the full diameter be available across the entire 11 inch central portion of photoconductor film 12 to ensure good cleaning of the area most commonly used. A typical engagement of brush 26' with film 12 is shown by dotted line 56 where it is clear that the central portion of photoconductor film 12 will be more heavily cleaned by brush 26' than portions 40. End portions of photoconductor film 12 contact end portions 40 with middle portion 38 of brush 26' contacting the middle portion of photoconductor film 12. During operation end portions 40 and central portion 38 of cleaner brush 26' are desirably in engagement with the corresponding sections of photoconductor film 12. As shown by dotted line 54, the brush cleaner may also engage brush 26'.

Figure 6:
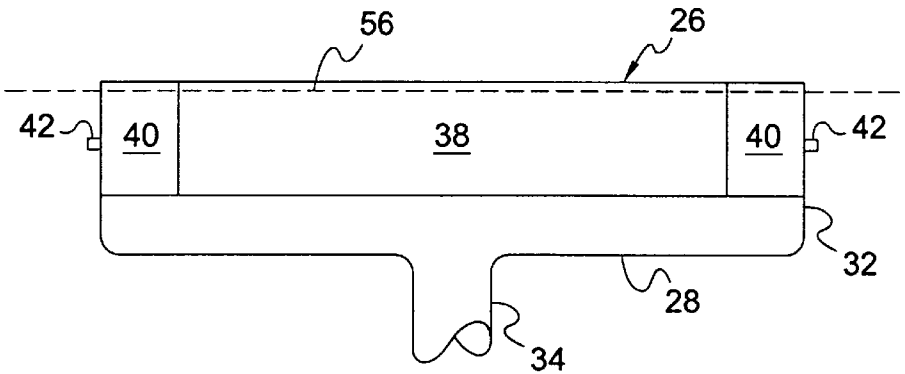

In FIG. 6, an alternate embodiment of the present invention is shown. As shown, the diameter of brush 26" is constant along its length. The engagement of brush 26" is substantially the same along its entire length. The end portions 40 comprise a brush surface which has a reduced coefficient of friction with end sections of the photoconductor film contacted by end sections 40. The brush surface may comprise bristles which are more flexible or which otherwise have a lower coefficient of friction with the photoconductor film contacted by end portions 40 or the like. The bristles may be more flexible or may be treated on their surface to achieve the desired lower coefficient of friction.

This lower coefficient of friction results in a lighter cleaning of the end portions of film 12 thereby extending its life. A similar lighter cleaning with a reduced coefficient of friction between the brush and the end portions of photoconductor film 12 is achieved by the brush shown in FIG. 4 by reducing the length of the brush bristles in end portions 40.

According to the present invention a lighter cleaning is applied to the end portions of photoconductor film 12 which do not include significant quantities of toner as a contaminate and which are otherwise more rapidly worn by brush 26". The net result is that end portions 40 are adequately cleaned but without excessive wear to photoconductor film 12. Accordingly the useful life of photoconductor film 12 is extended while still achieving adequate cleaning by the use of the improved brush of the present invention.

The improved brush of the present invention comprises a brush surface comprising brush fibers around a brush core, the brush surface having brush surface ends, a central portion of the brush surface having outer ends and end portions of the brush surface positioned between the brush surface ends and the outer ends, the end portions of the brush surface having a lower coefficient of friction with the film than the central portion of the brush surface.

The improved brush of the present invention further comprises an outer brush surface comprising brush fibers around a brush core with the outer brush surface having outer brush surface ends 39, a central portion 38 of the outer brush surface having outer ends 41 and a central portion outer diameter and end portions 40 of the outer brush surface positioned between the brush surface ends 39 and the outer ends 41 and having an end portion outer diameter less than the central portion 38 outer diameter. While the brush core has not been shown in the Figures it is considered that the use of a brush core to support the brush surface is well known to those skilled in the art.

The invention further comprises a method for extending the life of a photoconductor film in an electrophotgraphic process wherein the film is cleaned by a rotary brush. The method comprises cleaning the middle portion of the film by contact with the brush at a first coefficient of friction and cleaning end portions of the film by contact with the brush at a second coefficient of friction, the second coefficient of friction being less than the first coefficient of friction.

Improved cleaning and extended film life is accomplished by an method for removing contaminates from a photoconductor film used in a electrophotographic process wherein the method comprises forming a rotary cleaning brush to have a central portion and end portions with the central portion having an outer diameter from about 0.01 to about 0.05 and preferably from about 0.02 to about 0.04 inches greater than the outer diameter of the end portions; supporting the rotary cleaning brush to engage the photoconductor film in its central portion at an engagement of from about 0.02 to about 0.07 inches; and, passing the photoconductor film past and in engagement with the rotary cleaning brush to remove contaminants from the photoconductor film.

According to the present invention extended photoconductor film life is achieved by an improvement in a method for removing contaminants from a photoconductor film used in an electrophotographic process by passing the photoconductor film past and in engagement with a rotary cleaning brush with contaminants being at least partially removed from the cleaning brush, the improvement comprising forming the rotary cleaning brush to have a central portion which engages a central portion of the photoconductor film and end portions which engage end portions of the photoconductor film with a diameter of the central portion of the cleaner brush being from about 0.01 to about 0.05 inches greater than the diameter of the end portions of the cleaning brush.

Further it has been discovered that an improvement is achieved in a method for removing contaminants from a photoconductor film used in electrophotographic process by Further it has been discovered that an improvement is achieved in a method for removing contaminants from a photoconductor film used in electrophotographic process by passing the film past and in engagement with a rotary cleaning brush with contaminants being at least partially removed from the cleaning brush by an improvement comprising forming the rotary brush to have the central portion which engages the central portion of the photoconductor film and end portions which engage end portions of the photoconductor film with a central portion of the brush engaging a central portion of the film at a coefficient of friction greater than the coefficient of friction between the end portions of the film and the end portions of the brush.

According to the present invention an improved photoconductor film life is achieved by the use of the brush cleaner of the present invention and the method of the present invention.

Having thus described the present invention by reference to certain of its preferred embodiments it is pointed out that the embodiments described are illustrative rather than limiting in nature and that many variations and modifications are possible within the scope of the present invention. Many such variations and modifications may appear obvious and desirable to those skilled in the art based upon a review of the forgoing description of preferred embodiments.

Having thus described the invention, we claim:

1. A method for removing contaminants from and extending the life of a photoconductor film used in an electrophotographic process, the method comprising:

a) forming a rotary cleaning brush to have a central portion and end portions with the central portion having a diameter from about 0.01 to about 0.05 inches greater than the diameter of the end portions; and b) supporting the rotary cleaning brush to engage the photoconductor film in its central portion at an engagement of from about 0.02 to about 0.07 inches; and, c) passing the photoconductor film past and in engagement with the rotary cleaning brush to remove contaminants from the photoconductor film.

2. The method of claim 1 wherein the photoconductor film is a continuous loop of photoconductor film.

3. The method of claim 1 wherein contaminants are removed from the cleaning brush by the use of a vacuum suction.

4. In a method for removing contaminants from a photoconductor film used in an electrophotographic process by passing the film past and in engagement with a rotary cleaning brush with contaminants being at least partially removed from the cleaning brush, the improvement comprising: forming the rotary cleaning brush to have a central portion which engages a central portion of the photoconductor film and end portions which engage end portions of the photoconductor film with a diameter of the central portion of the cleaner brush being from about 0.01 to about 0.05 inches greater than the diameter of the end portions of the cleaning brush.

5. The improvement of claim 4 wherein the cleaning brush in its central portion has an engagement of about 0.02 to about 0.07 inches with the central portion of the photoconductor film.

6. An electrophotographic printer comprising:

a photoconductor film for transferring a toner image, the photoconductor film being passed by a rotary brush;

the rotary brush having a plurality of fibers disposed on a core to form a brush having a central portion and two end portions, the outer diameter of the end portions being less than the outer diameter of the central portion; and a support to engage the rotary brush with the photoconductor film to clean the photoconductor film such that a lighter cleaning of the photoconductor film is applied by the end portions than the central portion.

7. An electrophotographic printer in accordance with claim 6, wherein the diameter of the end portions is from about 0.01 to about 0.05 inches less than the central portion diameter.

8. An electrophotographic printer in accordance with claim 6, wherein the central portion has an engagement of about 0.02 to about 0.07 inches with the central portion of the photoconductor.

9. An electrophotographic printer in accordance with claim 6, wherein the central portion is about 11 inches long.

10. A method of operating an electrophotographic printer comprising the steps of:

providing a photoconductor film for transferring a toner image;

passing the photoconductor film by a rotary brush;

supporting a rotary brush for engaging with and cleaning the photoconductor film, the rotary brush having a plurality of fibers disposed on a core to form a brush having a central portion and two end portions, the outer diameter of the end portions being less than the outer diameter of the central portion such that a lighter cleaning of the photoconductor film is applied to the end portions.

11. The method of claim 10, wherein the diameter of the end portions is from about 0.01 to about 0.05 inches less than the central portion diameter.

12. The method of claim 10, wherein the central portion has an engagement of about 0.02 to about 0.07 inches with the central portion of the photoconductor.

13. The method of claim 10, wherein the central portion is about 11 inches long.

14. An electrophotographic printer comprising:

a photoconductor film for transferring a toner image, the photoconductor film being passed by a rotary brush;

the rotary brush having a plurality of fibers disposed on a core to form a brush having a central portion and two end portions, the outer diameter of the end portions being less than the outer diameter of the central portion; and a support to engage the rotary brush with the photoconductor film to clean the photoconductor film such that the central portion engages the photoconductor film at a coefficient of friction greater than the coefficient of friction between the end portions and the film.

15. An electrophotographic printer in accordance with claim 14, wherein the diameter of the end portions is from about 0.01 to about 0.05 inches less than the central portion diameter.

16. An electrophotographic printer in accordance with claim 14, wherein the central portion has an engagement of about 0.02 to about 0.07 inches with the central portion of the photoconductor.

* * * * *